United States Patent [19]

McNally et al.

[11] 4,082,045

[45] Apr. 4, 1978

[54] STABILITY BRACING FOR TWIST ON HIGH GONDOLAS OR HOPPER CARS

[75] Inventors: George S. McNally, South Holland, Ill.; Dilip T. Naik, Hammond; John H. Spence, Munster, both of Ind.

[73] Assignee: Pullman Incorporated, Chicago, Ill.

[21] Appl. No.: 730,510

[22] Filed: Oct. 7, 1976

[51] Int. Cl.[2] ..... B61D 17/00

[52] U.S. Cl. ..... 105/411; 105/406 R; 105/407; 105/409

[58] Field of Search ..... 105/406 R, 411, 413, 105/414, 396, 404, 407, 244, 247, 248, 249, 409; 296/28 M, 40; 52/146, 149, 264, 690, 691, 693

[56] References Cited

U.S. PATENT DOCUMENTS

| | | | |
|---|---|---|---|
| 1,766,856 | 6/1930 | Van Dorn | 105/406 R |
| 1,799,270 | 4/1931 | Wine | 105/406 R |
| 3,713,399 | 1/1973 | Bembridge et al. | 105/413 X |
| 3,817,189 | 6/1974 | Bailey et al. | 105/406 R |
| 3,964,399 | 6/1976 | Miller et al. | 105/411 X |

FOREIGN PATENT DOCUMENTS

| | | | |
|---|---|---|---|
| 1,080,883 | 8/1967 | United Kingdom | 52/693 |

*Primary Examiner*—Drayton E. Hoffman
*Assistant Examiner*—Randolph A. Reese
*Attorney, Agent, or Firm*—Thomas G. Anderson

[57] ABSTRACT

A high volume railway gondola car particularly suited for high speed rail operations having a bracing structure extending the length of the car including a plurality of serially interconnected V-shaped trusses having laterally longitudinally downwardly convergent bracing members coupling the car walls to the underframe along the centerline of the car.

5 Claims, 5 Drawing Figures

STABILITY BRACING FOR TWIST ON HIGH GONDOLAS OR HOPPER CARS

BACKGROUND OF THE INVENTION

1. Field of the Invention

The present invention relates to railway freight cars and specifically to open top gondola cars particularly suited for high speed unit train operations.

2. Description of the Prior Art

During rail movement of a high volume railway gondola car, uneven track, truck hunting and shifting cargo bulk can cause severe end-to-end torsional deflection and bulging of the car walls as well as warping or sagging of the center portions of the car. Because of the oscillatory character and structural interdependence of these types of car flexure, one tends to exaggerate or accentuate the destructive character of the other, thus promoting premature fatique and inhibiting the high speed roadability of the car.

U.S. patent application Ser. No. 625,606 filed Oct. 24, 1975, now U.S. Pat. No. 4,024,821, discloses a pair of crossed braces for a gondola car. Attention is also directed to U.S. Pat. Nos. 1,859,261; 1,834,264; 2,033,566; 2,146,221 and 2,464,080 which show a variety of wall braces coupling the side walls of a hopper car to the car floor or underframe. None, however, show a bracing system which essentially eliminates mutually accentuating end-to-end twisting of the car and sagging and bulging of the center portions of the car.

SUMMARY OF THE INVENTION

The object of the present invention is to provide a high volume railway gondola car particularly suited to high speed rail operations.

The invention provides a plurality of laterally longitudinally downwardly convergent bracing members which couple the upper portions of the side walls and the cover caps to the car floor and underframe along the centerline of the car. By this means, the bracing system arrests torsional end-to-end twisting of the car body; and, since the braces resist bulging deflection of the side walls, the vertical alignment and thus the beam strength of the walls is assured, thereby substantially reducing fatiguing vertical deflection or sagging-like flexure of the center portions of the car as well as reducing the magnitude of car body vibration.

DESCRIPTION OF THE PREFERRED EMBODIMENT

Figure 1:
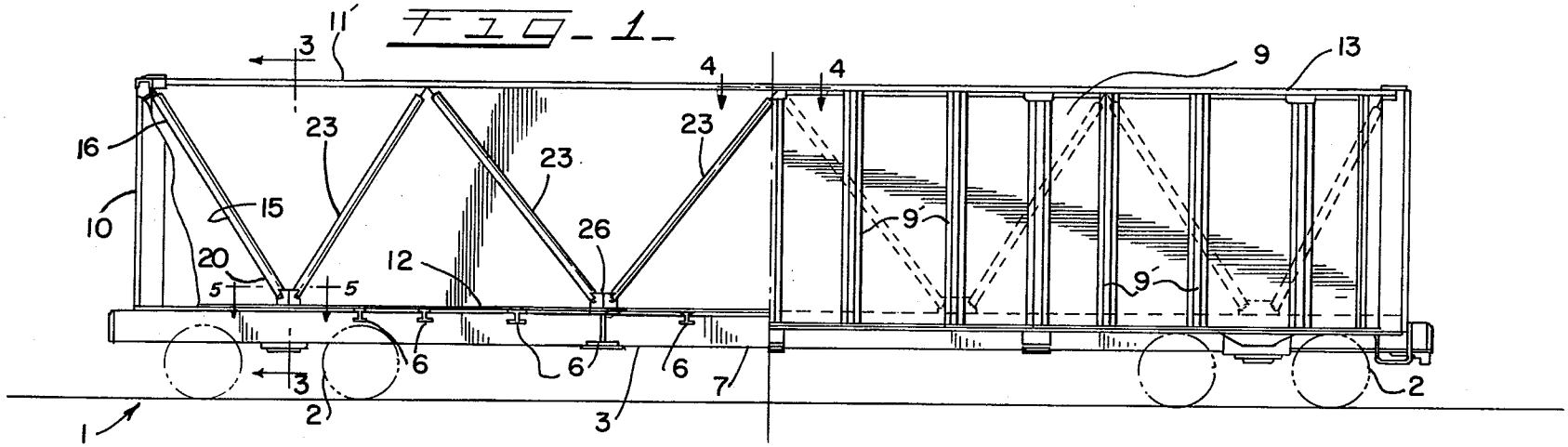
FIG. 1 is a side elevation view of a high volume railway gondola car having part of its side wall cut out to show the triangular truss-like braces of the present invention.
Figure 2:
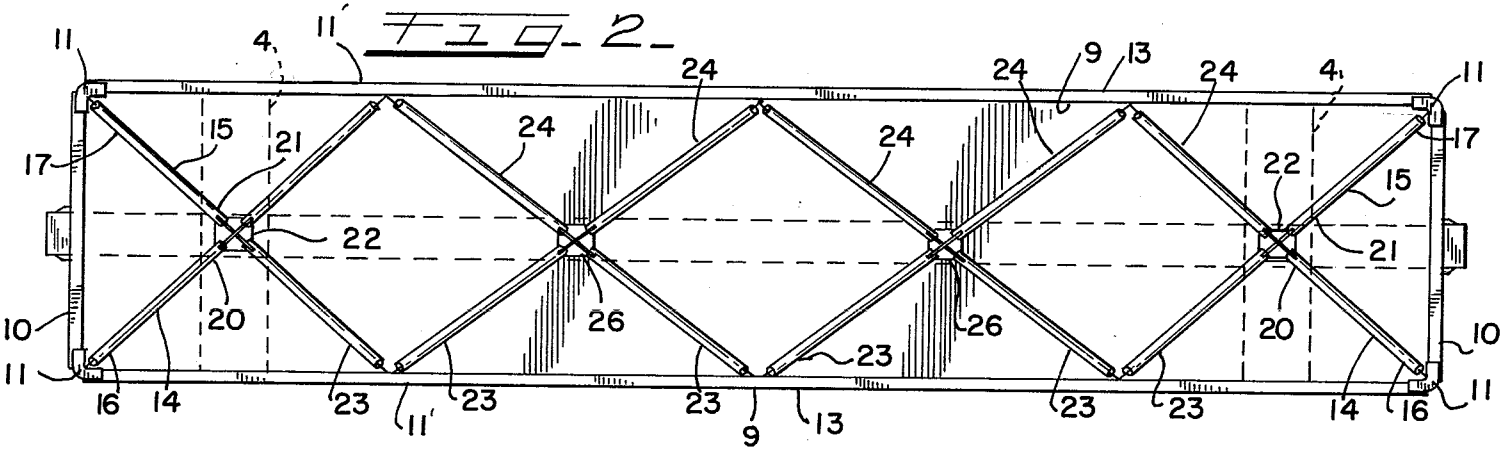
FIG. 2 is a plan view of the railway car of FIG. 1.

The car body bracing system of the present invention is adapted for use in a high volume railway gondola car as shown in FIG. 1. The car 1 is supported on conventional wheel trucks 2 and has an underframe 3 including transverse car body bolster beams 4, an elongated center sill 5 and a plurality of longitudinally spaced horizontal cross-bearers 6 fixed to the center sill 5 and extending outwardly therefrom to longitudinally extending side sills 7. To accommodate pivotal or rotative movement of the trucks 2 beneath the underframe 3, a conventional center bearing assembly including car body center plate 8 and truck center plate bowl (not shown in the drawings) is interposed between each truck 2 and the underframe 3.

The wall structure of the car 1 includes side walls 9 and end walls 10 and provides that the lower ends or edges of the side walls 9 and vertical side posts 9' be suitably connected to the side sills 7 and that the upper ends or edges of the side walls 9 be connected to upper side plate 11' longitudinally extending between the end walls 10. The upper edges of the side walls 9 and the end walls 10 are coupled together by overlying corner members or caps 11. To enclose the bottom of the car body the car includes floor plating 12 carried by the center sill 5, bolster beam 4, and crossbearers 6. It should be particularly noted that the side walls 9 are carried by the car body bolster beams 4 and thus significantly contribute to the longitudinal beam strength resistive to vertical deflection or sagging of the car body. However, because of the thinness of the side plates 9 relative to their height as well as the distance between the bolsters 4 through which the side walls must carry and transfer the car body loads, it is essential to provide a means of assuring the verticality of the side walls 9 to optimize their load carrying capacities. Thus, as discussed above in regard to the prior art, any bulging of the car walls or parallelogram-like flexure of the car body will significantly reduce strength of the car as well as limit its high speed roadability.

Figure 3:
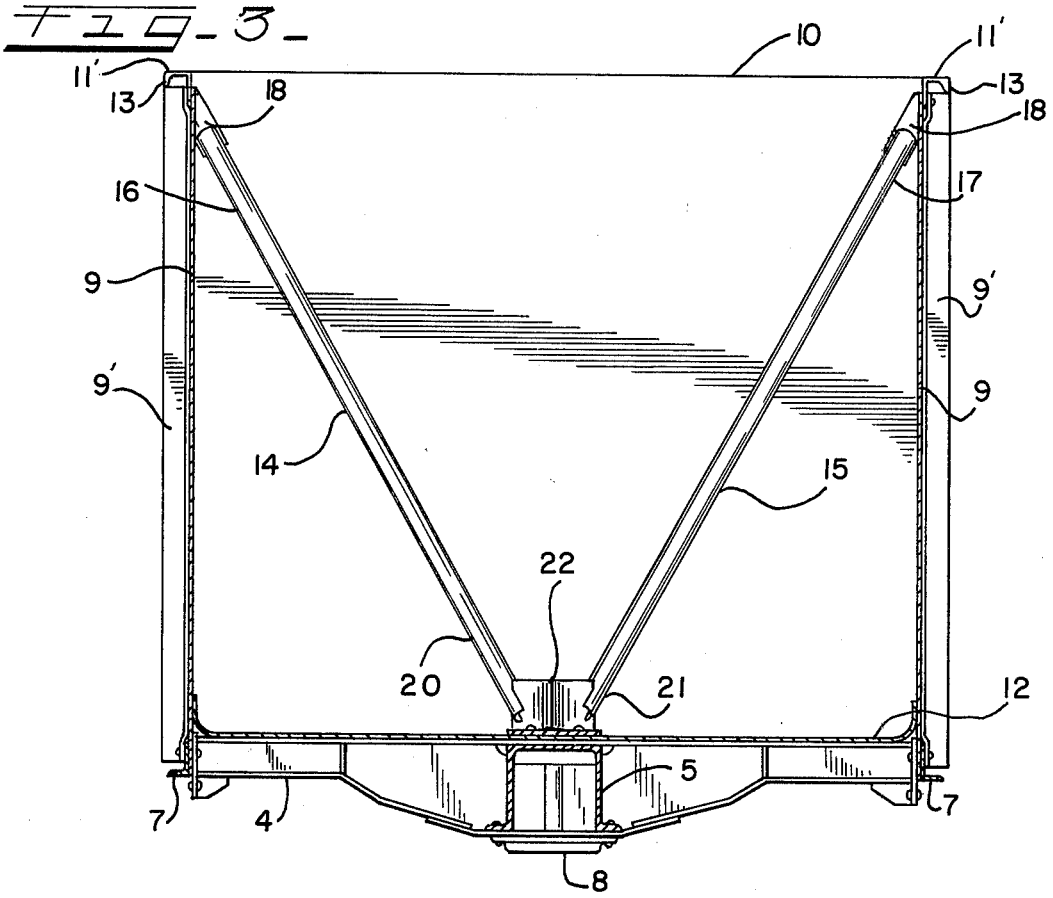
FIG. 3 is an enlarged cross-sectional view taken generally along line 3—3 in FIG. 1.
Figure 4:
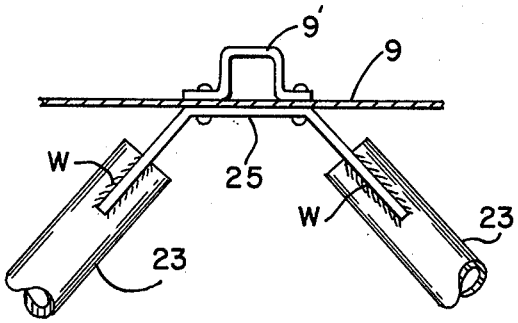
FIG. 4 is an enlarged section taken generally along line 4—4 in FIG. 1.
Figure 5:
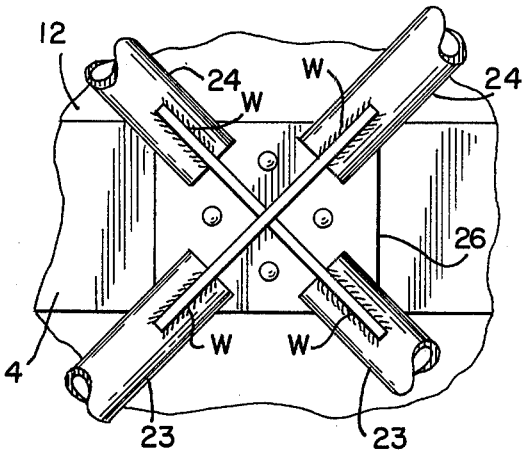
FIG. 5 is an enlarged section taken generally along line 5—5 in FIG. 1.

To arrest and limit deliterious end and side wall flexure, the invention provides a car bracing system including a plurality of laterally longitudinally downwardly convergent bracing members which couple the corner caps 11 and upper portions 13 of the side walls 9 to the car floor 12 and center sill 5 along the centerline of the car. Specifically, rigid elongated end braces or members 14 and 15 are provided at each end of the car to arrest relative movement between the corner caps 11 and the minimum flexure points of the car body located immediately above the center bearing assemblies. As shown in FIGS. 3 and 5, the upper end sections 16 and 17 of the end braces 14 and 15 are welded or otherwise appropriately secured to cap attachment flanges 18 depending from the caps 11, and the lower end sections 20 and 21 of the end braces 14 and 15 are similarly coupled to the floor 12, bolster 4 and center sill 5 by the coupling bracket 22 upstanding therefrom. To arrest bulging and thus sagging and to further resist end-to-end twisting of the car body, intermediate braces 23 and 24 are provided. The upper ends or sections of the braces 23 and 24 are coupled to the side walls by wall attachment brackets 25 such as illustrated in FIG. 4 and the lower ends or sections of the braces 23 and 24 are secured to the floor 12 and center sill 5 by upstanding coupling brackets 26 by welding or other appropriate means.

From the above, it can be seen that the braces 23 and 24 cooperate with the car wall, center sill and floor structure and form a plurality of triangular trusses which essentially eliminate destructive parallelogram-like flexure and bulging of the car walls as well as accentuated fatique and vibration of the car structure.

The foregoing description and drawings merely explain and illustrate the invention and the invention is not limited thereto, except insofar as the appended claims are so limited, as those skilled in the art who have the disclosure before them will be able to make modifications and variations therein without departing from the scope of the invention.

What is claimed is:

1. An open top high volume railway car body including a pair of side walls and interconnecting end walls defining vertically extending corner portions, a car underframe connected to a lower portion of said body including center bearing assemblies adapted to support said underframe on longitudinally spaced car trucks, said underframe including a center sill and longitudinally spaced transversely extending horizontal support means supported on said bearing assemblies, the intersection of said center sill and said horizontal support means defining minimum vertical flexure portions longitudinally spaced from said end walls and laterally inwardly from said side walls bracing means extending the length of the car body and reactive therewith to resist sagging and end-to-end torsional twisting thereof, said bracing means including a plurality of serially interconnected V-shaped trusses, said trusses each having downwardly inwardly longitudinally convergent reinforcing braces including upper end sections adjacent an associated side wall and lower end sections terminating adjacent said center sill and upper coupling means securing said upper end sections to said associated side wall and lower coupling means securing said lower end sections at spaced locations along said center sill wherein two of said locations are at said minimum flexure portions.

2. The invention according to claim 1, and said bracing means including a pair of Trusses longitudinally converging at said lower coupling means.

3. The invention according to claim 1, and said horizontal support means having a transverse bolster beam in load supporting relation to said side walls.

4. The invention according to claim 1, and each of said braces being a rigid elongated tension and compression member.

5. The invention according to claim 1, and said reinforcing braces of one of said trusses having lower end sections terminating proximate to an associated vertical flexure portion, and said braces laterally and longitudinally bisecting associated corner portions.

* * * * *